US005975197A

United States Patent [19]

Kado

[11] Patent Number: 5,975,197

[45] Date of Patent: Nov. 2, 1999

[54] HEAT EXCHANGER

[75] Inventor: Hirotaka Kado, Isesaki, Japan

[73] Assignee: Sanden Corporation, Gunma, Japan

[21] Appl. No.: 09/024,112

[22] Filed: Feb. 17, 1998

[30] Foreign Application Priority Data

Feb. 21, 1997 [JP] Japan ..... 9-053940

[51] Int. Cl.[6] ..... F28F 9/007

[52] U.S. Cl. ..... 165/149; 165/67

[58] Field of Search ..... 165/67, 149

[56] References Cited

U.S. PATENT DOCUMENTS

| | | | |
|---|---|---|---|
| 3,265,126 | 8/1966 | Donaldson | 165/149 |
| 4,938,284 | 7/1990 | Howells | 165/149 |
| 5,236,042 | 8/1993 | Kado | 165/149 |
| 5,348,079 | 9/1994 | Tanaka | 165/67 |
| 5,535,819 | 7/1996 | Matsuura | 165/149 |

FOREIGN PATENT DOCUMENTS

| | | | |
|---|---|---|---|
| 92492 | 7/1990 | Japan | 165/149 |

*Primary Examiner*—Leonard Leo
*Attorney, Agent, or Firm*—Baker & Botts, L.L.P.

[57] ABSTRACT

A heat exchanger includes a pair of header pipes, each having an end closed by a header cap; a plurality of heat transfer tubes interconnecting the header pipes; a plurality of fins; a side fin disposed on the outer surface of at least one of the outermost heat transfer tubes; and a side plate disposed on the outer surface of the side fin. The header cap comprises a header pipe connecting portion and a portion extending toward the side fin and side plate and having a concave portion engaged with the side fin and side plate. The header pipe and the side fin and side plate are connected to each other by the header cap; in particular, by the extended portion of the header cap, when assembled and brazed. The rotational shifting of the header pipe and the positional shifting of the side fin and side plate in the brazing process are prevented by the structure of the header cap.

8 Claims, 5 Drawing Sheets

HEAT EXCHANGER

BACKGROUND OF THE INVENTION

1. Field of the Invention

The present invention relates to a heat exchanger suitable for use in automobiles, and more particularly, to an improved structure for the header cap portion and vicinity of each end portion of the header pipes of a multi-flow type heat exchanger.

2. Description of the Related Art

A multi-flow type heat exchanger, for example, used as a condenser or as an evaporator for an air conditioner in automobiles, typically comprises a pair of header pipes, a plurality of heat transfer tubes interconnecting the pair of header pipes, and fins disposed between the heat transfer tubes. The members forming the heat exchanger are first assembled, and then the assembly is integrally brazed in a furnace to form a heat exchanger.

An example of such a heat exchanger is shown in FIG. 6. During the heating phase of the brazing process, header pipe 101 may rotate at of its proper position due to an external force, such as gravity or vibration. In such a situation, inlet or outlet pipe 102, or attachment support 103 may also shift from a proper position as shown in FIG. 7, making it difficult to form a heat exchanger having a desired shape. Moreover, a connecting portion of heat transfer tube 104 and header pipe 101 may shift, which may result in an increased possibility that the heat exchanger will leak.

Further, although the heat exchanger core prepared as an assembly is secured by a jig 105 during the brazing process, fins (not shown) or heat transfer tubes 104 may become deformed or may shift due to an excessive fastening force applied by jig 105, or by a difference in thermal expansion between the heat exchanger core and jig 105. In particular, as shown in FIG. 8 (described in Japanese Utility Model Laid-Open SHO 64-46680), an end portion of side fin 113, which is disposed on the outer surface of the outermost heat transfer tube 112*a* of a plurality of heat transfer tubes 112 connected to header pipe 111, may positionally shift, deform or improperly connect despite the presence of side plate 114. This may result in problems as shown in FIGS. 9A and 9B. FIG. 9A shows an example in which the end portion of side fin 113 has shifted out of a proper position to a position below the proper position. FIG. 9B shows an example in which side fin 113 and side plate 114 have shifted together from a proper position.

In order to prevent such positional shifts, a structure is proposed in JP-A-HEI 7-120190 wherein respective plate portions are provided to a side member (corresponding to a side plate of the present invention) and a header cap, and the plate portions are brazed to each other in an abutted condition.

However, although the positional shift between a header pipe and a side plate may be prevented, to some extent by such a proposal, it is still not satisfactory. In particular, the prevention of the positional shift of a side fin is still insufficient.

SUMMARY OF THE INVENTION

Accordingly, it is an object of the present invention to provide an improved structure of a header cap and vicinity of each end portion of the header pipes of a multi-flow type heat exchanger which may sufficiently prevent both the rotational shifting of a header pipe and the positional shifting of the side of a side fin.

It is another object of the present invention to provide an improved structure of the heat exchanger for securing an attachment support or a reinforcement member (a side support) that is strong.

To achieve the foregoing and other objects, the structure of a heat exchanger according to the present invention is herein provided. The heat exchanger includes a pair of header pipes each having an end closed by a header cap, a plurality of heat transfer tubes interconnecting the pair of header pipes, a plurality of fins disposed between each adjacent heat transfer tube, a side fin disposed on the outer surface of at least one of the outermost heat transfer tubes, and a side plate disposed on the outer surface of the side fin. The header cap comprises a header pipe connecting portion connected to the end of the header pipe and an extended portion extending toward the side fin and side plate. The extended portion has a concave portion engaged with the side fin and side plate.

The header cap is temporarily fixed to the end of the header pipe by, for example, a spot weld formed by MIG spot welding, to close the end of the header pipe. Thereafter, the header cap, the side fin, and the side plate are integrally brazed in a furnace together with the entire heat exchanger.

An attachment support may be secured to the extended portion of the header cap. The attachment support may comprise a bracket for attaching the heat exchanger to, for example, a body of an automobile, or a bracket for attaching other equipment to the heat exchanger. Such an attachment support may be secured to the extended portion by a fastener fixed to an engaging portion that is provided to the extended portion. The engaging portion may be formed as a female screw defined at a location on the extended portion between the header pipe connecting portion and the concave portion. The fastener may comprise a male screw and the fastener may be received by the female screw.

The heat exchanger may further comprise a side support disposed on the outer surface of the side plate as a reinforcement member. In this embodiment, the extended portion may have an engaging portion engaged with the side support. The side support has, for example, a U-shaped cross section at a position engaging the extended portion. The extended portion may have an attachment portion for securing the side support to the extended portion. This attachment portion may be formed as a groove having a semi-circular cross section, and the side support may be secured to the extended portion with a fastener (for example, a through bolt) extending through the groove.

In the heat exchanger, because the side fin and the side plate engage the concave portion of the header cap and the header cap is temporarily secured to the header pipe, the header pipe is positionally fixed by the engagement relative to the side fin and side plate. The side fin and side plate are secured to the core portion, comprising heat transfer tubes and fins, with a brazing jig. Therefore, the header pipe is positionally fixed by the side of the core portion of the heat exchanger in the brazing process. As a result, the rotational shifting of the header pipe in the heating phase of the brazing process may be prevented.

On the other hand, the end portion of the side fin engages the concave portion of the header cap and is secured to the concave portion together with the side plate, and the header cap is temporarily secured to the header pipe. Therefore, positional shifting of the side fin and side plate may also be prevented.

As a result, by changing the structure of a header cap, both the rotational shifting of the header pipe and the positional shifting of the side fin and side plate may be effectively prevented, thereby making a high-performance heat exchanger having a desired shape and a desired dimensional accuracy with a reduced possibility of leakage.

Moreover, the extended portion of the header cap, in particular, a portion of the extended portion other than the concave portion, may be used as an engaging portion with an attachment or reinforcing member. The attachment support or the side support may be secured to the engaging portion of the extended portion by forming an appropriate female screw or an appropriate groove on the extended portion and using an appropriate fastener, such as a male screw or a through bolt, secured to the female screw or to the groove. As a result, a desired attachment structure or reinforcement structure that is strong may be achieved by such a structure.

Further objects, features, and advantages of the present invention will be understood from the following detailed description of the preferred embodiments of the present invention with reference to the accompanying figures.

BRIEF DESCRIPTION OF THE DRAWINGS

Embodiments of the invention are now described with reference to the accompanying figures, which are given by way of example only, and are not intended to limit the present invention.

DETAILED DESCRIPTION OF PREFERRED EMBODIMENTS

Figure 1:
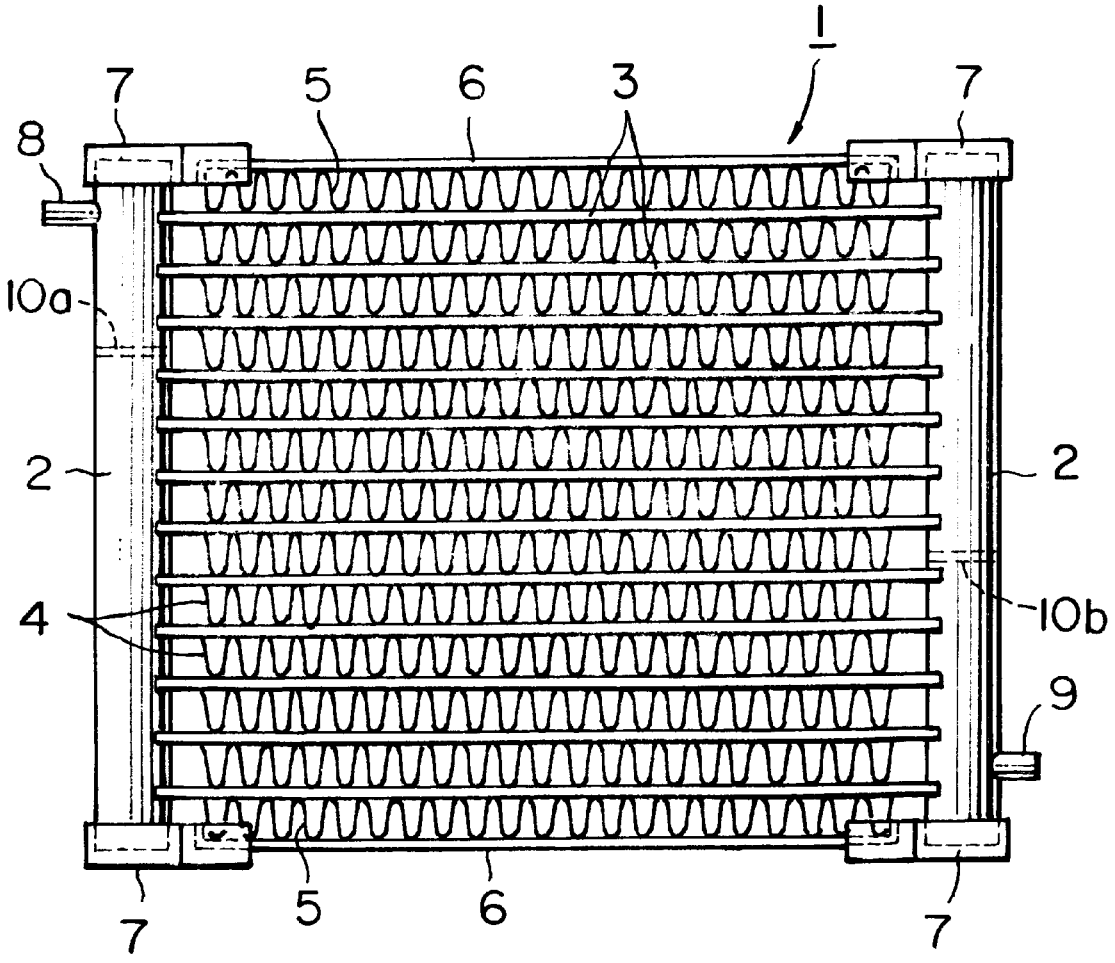
FIG. 1 is a side view of a heat exchanger according to a first embodiment of the present invention.
Figure 2:
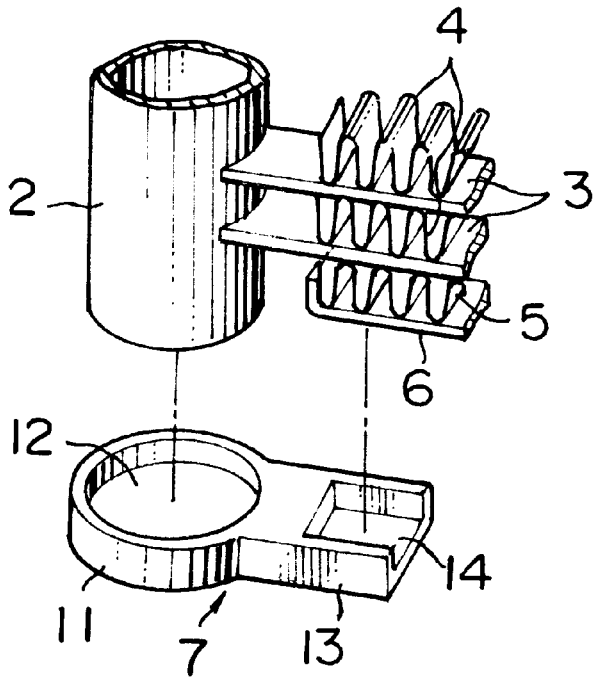
FIG. 2 is an enlarged, exploded, partial perspective view of the heat exchanger depicted in FIG. 1.
Figure 3:
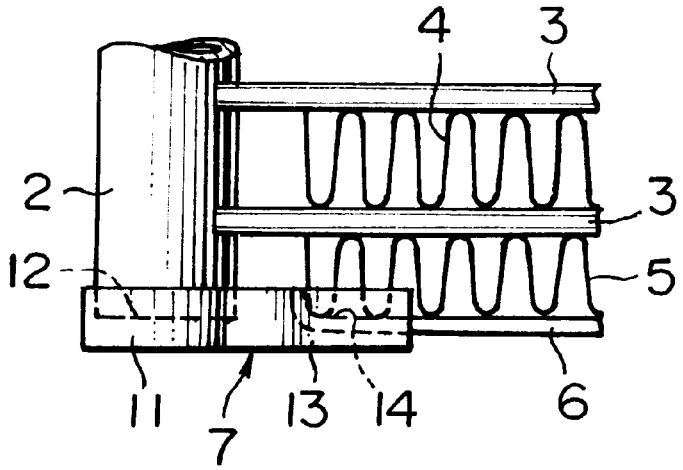
FIG. 3 is a side view of the portion depicted in FIG. 2, after brazing.

Referring to FIGS. 1 to 3, a heat exchanger of the present invention, specifically, a heat exchanger 1 used as an evaporator, is provided according to a first embodiment. Heat exchanger 1 includes a pair of header pipes 2 disposed parallel to each other. A plurality of heat transfer tubes 3 disposed parallel to each other with a predetermined interval (for example, flat-type refrigerant tubes) fluidly interconnect the pair of header pipes 2. Corrugated fins 4 are interposed between the respective adjacent heat transfer tubes 3. Side fin 5 is provided on the outer surface of each outermost heat transfer tube 3. Side fin 5 has substantially the same corrugated structure as fins 4. Side plate 6 is provided on the outer surface of each side fin 5. The end portions of each header pipe 2 are closed by header caps 7. Inlet pipe 8 is connected to one of header pipes 2, and outlet pipe 9 is connected to the other of header pipes 2. Heat exchanger medium (refrigerant) introduced through inlet pipe 8 circulates in a predetermined flow path formed in heat exchanger 1 by partition 10*a* in one of header pipes 2, partition 10*b* in the other of header pipes 2, and heat transfer tubes 3. The circulated heat exchanger medium is discharged through outlet pipe 9. Thus, heat exchanger 1 is constructed as a multi-flow type heat exchanger.

The portion of header cap 7 and its vicinity is structured as depicted in FIGS. 2 and 3. Although FIGS. 2 and 3 only depict the lower-side portion of one header pipe portion, other portions provided with header caps 7 have the same structure.

Header cap 7 comprises a header pipe connecting portion 11 connected to the end of header pipe 2 and an extended portion 13 extending toward side fin 5 and side plate 6 and engaged with and connected to the end portions of side fin 5 and side plate 6. Header pipe connecting portion 11 has circular recessed portion 12. The end of header pipe 2 is fitted into recessed portion 12. A concave portion 14 is formed on extended portion 13 to open upward in the figure and toward side fin 5 and side plate 6. Although the end portions of side fin 5 and side plate 6 are fitted into concave portion 14 and held from both sides by the side walls of concave portion 14 in this embodiment, any suitable engaging structure may be used.

Header cap 7 is formed as a simple shape which is easily press formed by, for example, forging, as depicted in FIG. 2. Therefore, header cap 7 may be produced inexpensively.

In the assembly of heat exchanger 1, after heat transfer tubes 3, fins 4, side fins 5, side plates 6 and header pipes 2 are assembled, header caps 7 are attached. At that time, header caps are temporarily fixed to corresponding header pipes 2 by, for example, a spot weld formed by MIG spot welding. While the core portion of the assembly is secured by a brazing jig, the assembly is brazed integrally in a furnace.

In such a heat exchanger 1, because the end portions of side fin 5 and side plate 6 are inserted into and fixed in concave portion 14 of header cap 7, which is temporarily secured to header pipe 2, header pipe 2 is connected to side fin 5 and side plate 6 via header cap 7. Therefore, header pipe 2 is fixed to the side of side fin 5 and side plate 6. Further, side fin 5 and side plate 6 are fixed to the core portion comprising heat transfer tubes 3 and fins 4 via a brazing jig. Consequently, the position of header pipe 2 is controlled by the core side of the heat exchanger, particularly in the rotational direction. Thus, the rotational shifting of header pipe 2 during the heating phase of the brazing process may be prevented.

As viewed from the side of side fin 5, the end portions of side fin 5 and side plate 6 are fitted into concave portion 14 of header cap 7, and are fixed to header cap 7. Because header cap 7 is temporarily secured to header pipe 2, the end portions of side fin 5 and side plate 6 are fixed to the side of header pipe 2, and, more precisely, to header cap 7, which is temporarily secured to header pipe 2. Consequently, the positional shifting of side fin 5 and side plate 6 are also prevented.

Thus, both the rotational shifting of header pipe 2 and the positional shifting of side fin 5 and side plate 6 are prevented by a structured header cap 7. This structured header cap 7 may be formed by, for example, forging, and a heat exchanger 1 having a desired shape and a desired dimensional accuracy may be produced inexpensively.

Figure 4:
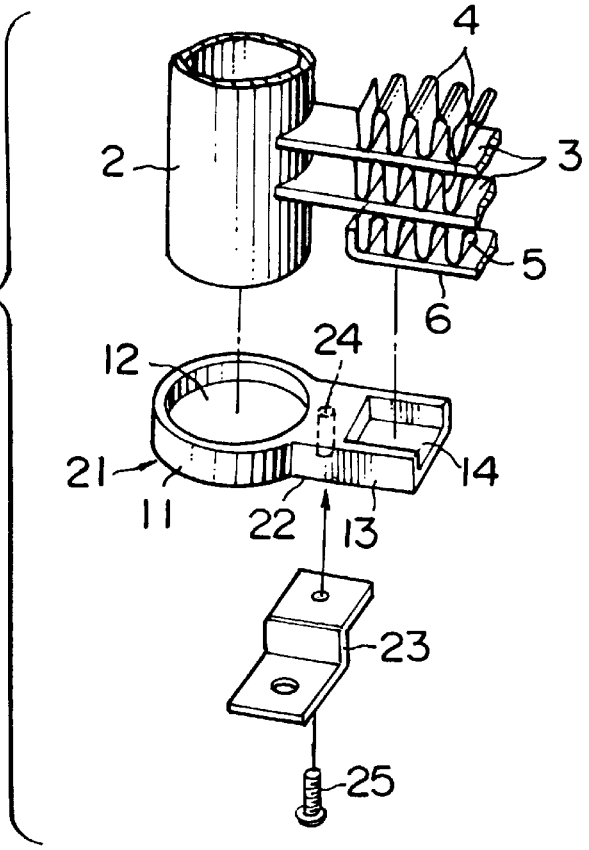
FIG. 4 is an exploded, partial perspective view of a heat exchanger according to a second embodiment of the present invention.

FIG. 4 depicts the structure of a header cap portion of a heat exchanger according to a second embodiment of the present invention. In this embodiment, header cap 21 has the same header pipe connecting portion 11 with recessed portion 12 and extended portion 13 with concave portion 14 engaged with the end portions of side fin 5 and side plate 6 as in the first embodiment, depicted in FIG. 2. A part of extended portion 13 of header cap 21 (a part of the bottom surface of extended portion 13) is formed as an engaging portion 22 engaged with an attachment support 23. A female screw 24 is defined on extended portion 13 at a location between recessed portion 12 of header pipe connecting portion 11 and concave portion 14. Attachment support 23 is fixed to header cap 21 at the bottom surface of extended portion 13 by fastening a screw 25 into female screw 24.

Thus, an appropriate engaging portion and fastening portion may be provided on extended portion 13 of header cap 21 for fixing of attachment support 23. In such a structure, a strong attachment structure for attachment support 23 may be achieved using header cap 21.

Figure 5:
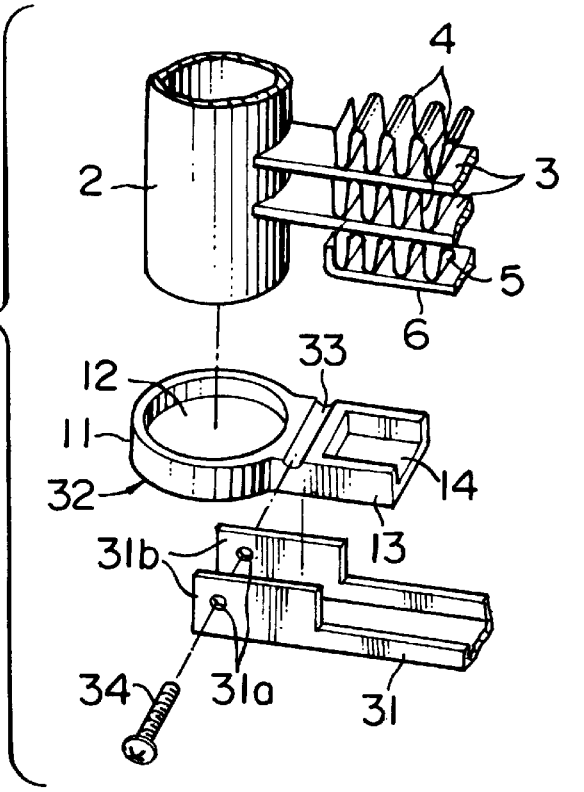
FIG. 5 is an exploded, partial perspective view of a heat exchanger according to a third embodiment of the present invention.
Figure 6:
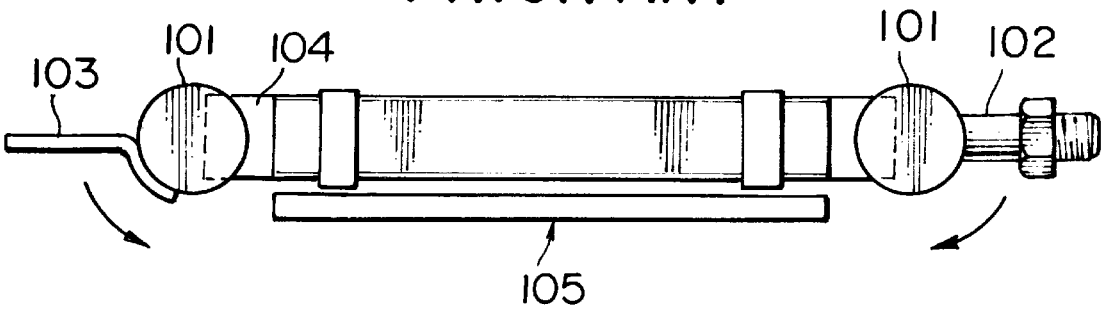
FIG. 6 PRIOR ART
FIG. 6 is an overhead view of a conventional heat exchanger that is partially assembled.
Figure 7:
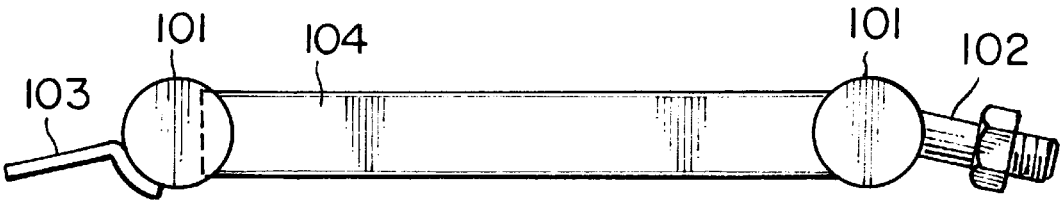
FIG. 7 PRIOR ART
FIG. 7 is an overhead view of the heat exchanger depicted in FIG. 6, depicting a rotational shifting of header pipes.
Figure 8:
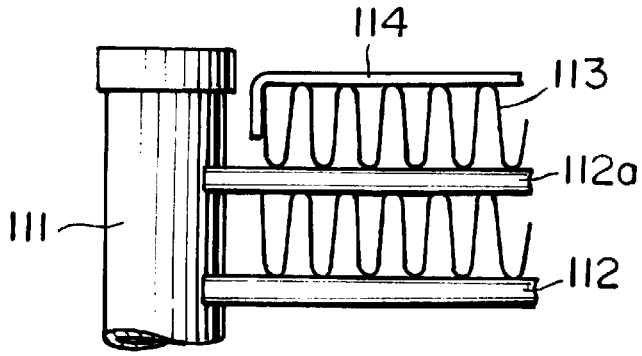
FIG. 8 PRIOR ART
FIG. 8 is a partial side view of a conventional heat exchanger.
Figure 9A:
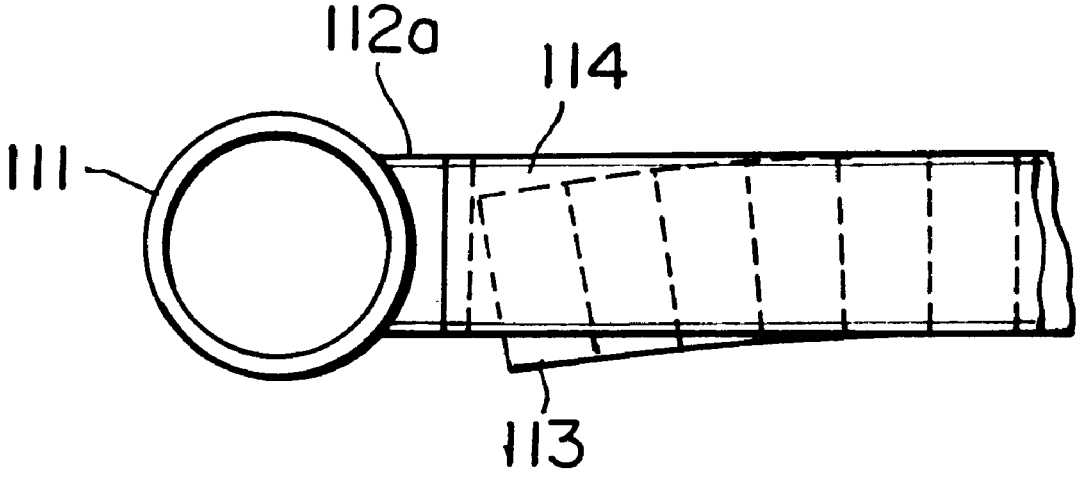
FIG. 9A PRIOR ART
FIG. 9A is a partial overhead view of the heat exchanger depicted in FIG. 8, showing a positional shifting problem.
Figure 9B:
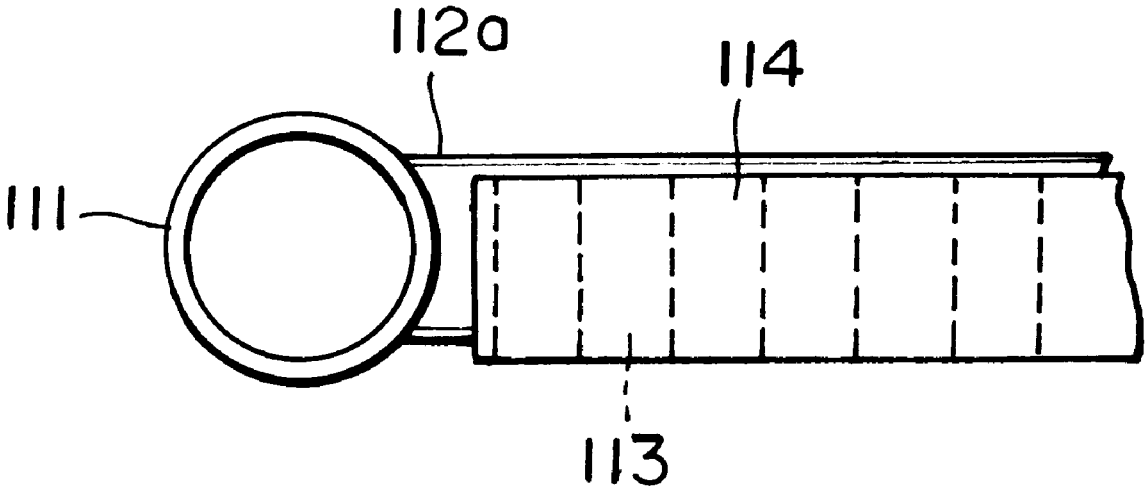
FIG. 9B PRIOR ART
FIG. 9B is a partial overhead view of the heat exchanger depicted in FIG. 8, showing another positional shifting problem.

FIG. 5 depicts the structure of a header cap portion of a heat exchanger according to a third embodiment of the present invention. In this embodiment, a side support 31 for reinforcement is further provided on the outer surface of side plate 6. Side support 31 has a U-shaped cross section at a position engaged with side plate 6. A through hole 31*a* is defined on each wall 31*b* forming the U-shaped cross section. Header cap 32 has the same header pipe connecting portion 11 with recessed portion 12 and extended portion 13 with concave portion 14 engaged with the end portions of side fin 5 and side plate 6 as in the first embodiment, depicted in FIG. 2. The whole or a part of extended portion 13 is formed as an engaging portion engaged with side support 31. An attachment portion 33 for securing side support 31 to header cap 32 is provided on extended portion 13 at a position between recessed portion 12 of header pipe connecting portion 11 and concave portion 14. In this embodiment, attachment portion 33 is formed as a groove having a semi-circular cross section. A fastener 34, such as a through bolt, may be inserted into through holes 31*a* to extend through groove 33 for securing side support 31 on extended portion 13 of header cap 32, after fitting side support 31 onto extended portion 13. By fastening fastener 34, side support 31 is secured to header cap 32.

Thus, an appropriate engaging portion and an appropriate fastening portion may be provided on extended portion 13 of header cap 32 for securing of side support 31. In such a structure, while header cap 32 is formed as a simple structure, a strong attachment structure for side support 31 may be achieved using header cap 32.

The present invention may be applied to any multi-flow type heat exchanger having a header cap without being limited to one depicted in FIG. 1. In particular, the present invention is useful to a heater, a condenser or an evaporator for an air conditioner used in automobiles.

Although several embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. A heat exchanger including a pair of header pipes each having an end closed by a header cap, a plurality of heat transfer tubes interconnecting said pair of header pipes, a plurality of fins disposed between each adjacent heat transfer tube, a side fin disposed on an outer surface of at least one of the outermost heat transfer tubes, and a side plate disposed on an outer surface of said side fin, said header cap comprising:

a header pipe connecting portion connected to said end of said header pipe; and an extended portion extending in a direction away from said header pipe toward said side fin and side plate and having a concave portion engaged with said side fin and side plate.

2. The heat exchanger of claim 1, wherein said header cap and said side fin and side plate are brazed.

3. A heat exchanger including a pair of header pipes each having an end closed by a header cap, a plurality of heat transfer tubes interconnecting said pair of header pipes, a plurality of fins disposed between each adjacent heat transfer tube, a side fin disposed on an outer surface of at least one of the outermost heat transfer tubes, and a side plate disposed on an outer surface of said side fin, said header cap comprising:

a header pipe connecting portion connected to said end of said header pipe; and an extended portion extending toward said side fin and side plate and having a concave portion engaged with said side fin and side plate;

wherein said extended portion has an engaging portion, and an attachment support is secured to said extended portion by a fastener fixed to said engaging portion.

4. The heat exchanger of claim 3, wherein said fastener is received by a female screw located at a position on said extended portion between said header pipe connecting portion and said concave portion.

5. A heat exchanger including a pair of header pipes each having an end closed by a header cap, a plurality of heat transfer tubes interconnecting said pair of header pipes, a plurality of fins disposed between each adjacent heat transfer tube, a side fin disposed on an outer surface of at least one of the outermost heat transfer tubes, and a side plate disposed on an outer surface of said side fin, said header cap comprising:

a header pipe connecting portion connected to said end of said header pipe;

an extended portion extending toward said side fin and side plate and having a concave portion engaged with said side fin and side plate; and a side support disposed on an outer surface of said side plate, said extended portion having an engaging portion engaged with said side support.

6. The heat exchanger of claim 5, wherein said side support has a U-shaped cross section at a position for engaging said extended portion.

7. The heat exchanger of claim 5, wherein said extended portion has an attachment portion for securing said side support to said extended portion.

8. The heat exchanger of claim 7, wherein said attachment portion is formed as a groove having a semi-circular cross section, and said side support is secured to said extended portion with a fastener extending through said groove.

* * * * *